US006123390A

United States Patent [19]

Greenwald

[11] Patent Number: 6,123,390

[45] Date of Patent: Sep. 26, 2000

[54] ORTHOPEDIC CHAIR

[76] Inventor: Louis A. Greenwald, 3895 Creston St., Dubuque, Iowa 52002

[21] Appl. No.: 09/036,977

[22] Filed: Mar. 9, 1998

[51] Int. Cl.[7] ..... A47C 7/02

[52] U.S. Cl. ..... 297/452.32; 297/452.25; 297/344.12

[58] Field of Search ..... 297/452.3, 452.31, 297/452.32, 452.28, 452.23, 452.24, 452.25, 452.26, 452.27, 344.12, 326, 344.19, 284.1, 284.4, 284.9, 284.11, 452.34, 467; 128/845

[56] References Cited

U.S. PATENT DOCUMENTS

| | | | |
|---|---|---|---|
| 1,917,264 | 7/1933 | Kellogg . | |
| 2,071,974 | 2/1937 | Gunlocke . | |
| 2,582,115 | 1/1952 | Goodeve . | |
| 3,232,253 | 2/1966 | Winters | 297/344.12 |
| 3,311,410 | 3/1967 | Hill | 297/423.11 X |
| 3,376,070 | 4/1968 | Johnson . | |
| 3,503,649 | 3/1970 | Johnson | 297/452.25 X |
| 3,642,319 | 2/1972 | Berchicci . | |
| 3,740,096 | 6/1973 | Bridger . | |
| 4,500,137 | 2/1985 | Morehouse . | |
| 4,534,590 | 8/1985 | Yamamura et al. . | |
| 4,556,254 | 12/1985 | Roberts . | |
| 4,607,882 | 8/1986 | Opsvik . | |
| 4,783,121 | 11/1988 | Luyk et al. . | |
| 4,889,387 | 12/1989 | Gregory . | |
| 4,915,449 | 4/1990 | Piretti | 297/326 |
| 5,163,737 | 11/1992 | Navach et al. . | |
| 5,433,409 | 7/1995 | Knopp | 297/344.19 X |
| 5,494,332 | 2/1996 | Daniel . | |

FOREIGN PATENT DOCUMENTS

| | | | |
|---|---|---|---|
| 163437 | 12/1985 | European Pat. Off. . | |
| 2421040 | 11/1974 | Germany | 297/452.25 |
| 811098 | 4/1959 | United Kingdom | 297/452.25 |

*Primary Examiner*—Milton Nelson, Jr.
*Attorney, Agent, or Firm*—James C. Nemmers

[57] ABSTRACT

An orthopedic chair designed to place the lumbar spine in a position of lordosis and to assist the user to sit more erect and not slouch. This takes stress off the cervical spine as well as the lumbar spine. The back of the chair has a lumbar roll positioned at the user's belt line and a seat contoured to support the user's thighs so that the knee joints are positioned below the hip joints. A pommel between the thigh supports keeps the user from sliding forwardly and presses the lumbar spine into the lumbar roll.

4 Claims, 2 Drawing Sheets

FIG. 4
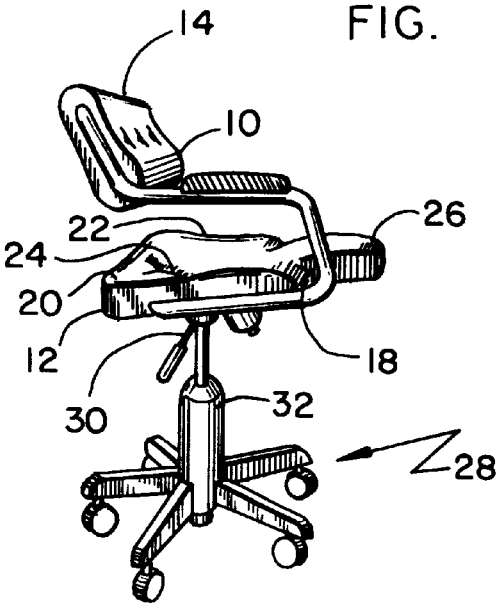
FIG. 5
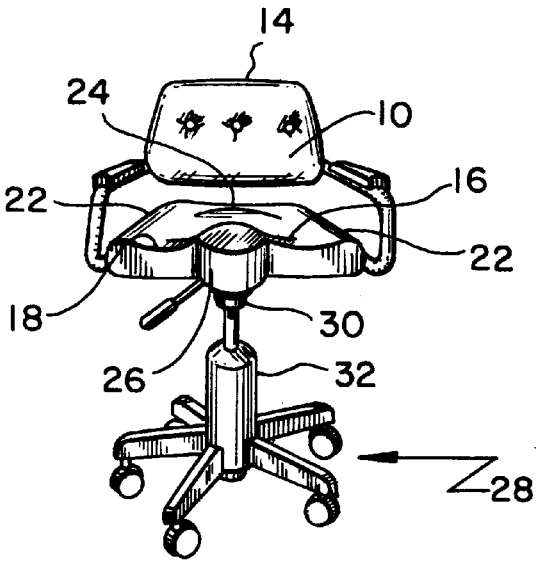
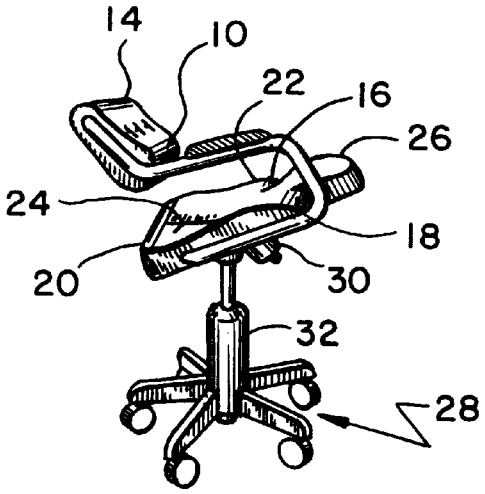
FIG. 6

ORTHOPEDIC CHAIR

BACKGROUND OF THE INVENTION

This invention relates to a chair for keeping the lumbar spine of a person seated in the chair in a position of lumbar lordosis. Lumbar lordosis is the natural position of the spine and is a protecting mechanism for the low back or lumbar spine. It is the position best suited for protecting the lumbar disc and the lumbar spine It is estimated that neck and back pain afflict as many as 90% of the population of the United States at some time during their lives. Back and neck pain are conditions very frequently seen on a regular basis by many physicians and other medical practitioners. Due to the sedentary nature of many individuals, sitting in a poor position is one of the causative or aggravating factors for individuals with low back and neck pain. Moreover, poor posture and poor sitting have been identified by many spine experts as an aggravating factor for individuals with cervical and lumbar spine problems.

The lumbar lordosis is the inward curve in the lumbar spine (concavity) that is the normal curve of the spine. As illustrated in FIG. 1, the lordosis is related to the position of the pelvis. When the pelvis is positioned in a position of anterior rotation or tilt, the lordosis is accentuated or maintained. However, as illustrated in FIG. 2, when a person sits in a slouched position, the pelvis is positioned in a position of posterior pelvic tilt and the lordosis is diminished or lost. The anterior pelvic tilt that is desired can be achieved by allowing the knees to be placed in a position that is lower than the hip joints. By positioning the knees lower than the hips, a stretch is placed on the anterior structures of the hip joint including the flexors of the hip. This stretch assists the pelvis in tilting anteriorly which is desirable. On the other hand, if the knee joint is placed above or level with the hip joint, then a stretch is taken off the anterior structures and the pelvis will rotate posteriorly and the lumbar lordosis will be lost.

There have been many recent attempts to design chairs to prevent low back and neck pain. However, none of these attempts have been completely successful because they attempt to maintain the lordosis using only a lumbar roll in the back of the chair.

SUMMARY OF THE INVENTION

The chair of the invention is designed to place the lumbar spine in a position of lordosis and to assist the user to sit more erect and not slouch. This takes stress off the cervical spine as well as the lumbar spine. The chair has a back containing a lumbar roll positioned at the user's belt line and a seat contoured to support the user's thighs so that the knee joints are positioned below the hip joints. The seat also has a pommel positioned between the thigh supports to keep the user from sliding forwardly. The seat contour also comfortably presses the lumbar spine into the lumbar roll to maintain an anterior pelvic tilt.

BRIEF DESCRIPTION OF THE DRAWING

FIG. 4 is a perspective side view of a chair constructed according to the principles of the invention;

FIG. 5 is a perspective frontal view of a chair constructed according to the principles of the invention; and FIG. 6 is a perspective side view of a chair constructed according to the principles of the invention but showing the chair in a tilted position.

DESCRIPTION OF THE PREFERRED EMBODIMENT OF THE INVENTION

Figure 2:
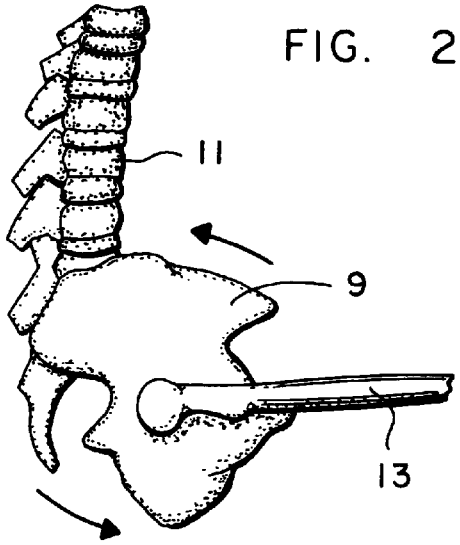
FIG. 2 is a schematic side view of the human lumbar spine and pelvis to illustrate posterior pelvic tilt.

Most known chairs that are currently available place the hip and knees on a level plane and tend to allow the pelvis 9 to rotate posteriorly as illustrated in FIG. 2. In this position, the lumbar lordosis is difficult to maintain. In order to this posterior pelvic tilt, many prior art chairs are designed with a lumbar roll to assist in holding the back in a position of lumbar lordosis. However, this alone does not prevent posterior pelvic tilt. The chair of the invention is designed with a unique seat and a lumbar roll to lock the low back into a position of lumbar lordosis. This unique combination does not allow the individual to slouch and therefore maintains the lumbar lordosis.

Figure 3:
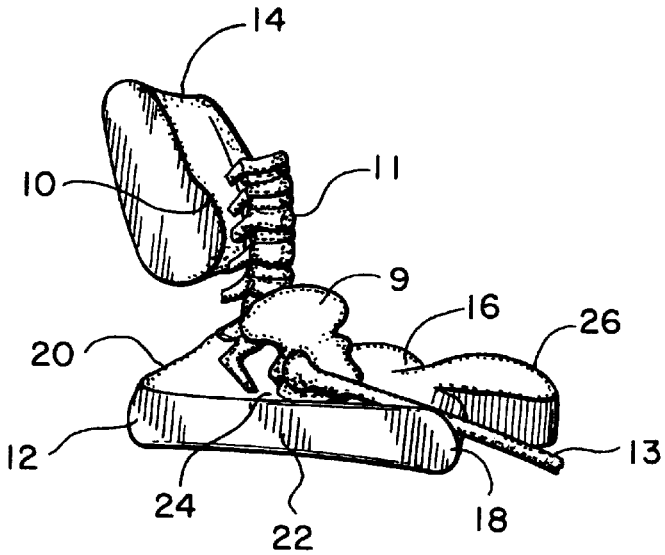
FIG. 3 is a perspective schematic view of the lumbar spine and pelvis combined with the lumbar roll and seat constructed according to the principles of the invention.

As illustrated in FIG. 3, a lumbar roll 10 is placed at the individual's belt line to push the lumbar spine 11 into a position of lordosis. As more fully described hereinafter, this is combined with a seat 12 that has a cutout and gutter 16 for the thighs so as to allow the femur 13 to angle downwardly and therefore position the knee joints below the hip joints. This combination allows the lumbar spine 11 to be locked into a position of lordosis when the individual is sitting. The cutout and the gutter 16 of the seat 12 also keeps the individual from crossing his/her legs which keeps the knee joint below the plane of the hip joints and maintains the pelvis 9 in anterior tilt so that the spine 11 is kept in a position of lordosis.

One version of a chair constructed according to the principles of the invention is shown in FIGS. 4, 5 and 6. The back 14 is provided with a lumbar roll 10 which is positioned at the individual's belt line and provides support for the lumbar spine. This lumbar roll 10 is designed with a convexity that will fit into the back and cause the back to be pushed into a concavity. The lumbar roll 10 preferably is padded but is firm enough to support the spine 11 and provide counter pressure so that the spine 11 is held in a concave or lordotic position. The convex surface of the lumbar roll 10 provides a counter pressure or support to the spine to keep it concave or lordotic.

The upper surface of the seat 12 is contoured so that the individual's thighs each have a gutter 16 in which the thighs rest, and there is a sloped anterior cutout 18 for each thigh so that the thighs slope downwardly when the hips are compared to the knees. The seat 12 is formed with a raised rear edge 20 and raised sides 22 and with a depression 24 for the buttocks and ischial tuberosity. The seat 12 preferably is padded but is firm enough to support the periphery of the buttocks and give relief to the ischial tuberosities and the posterior aspect of the thighs.

Figure 1:
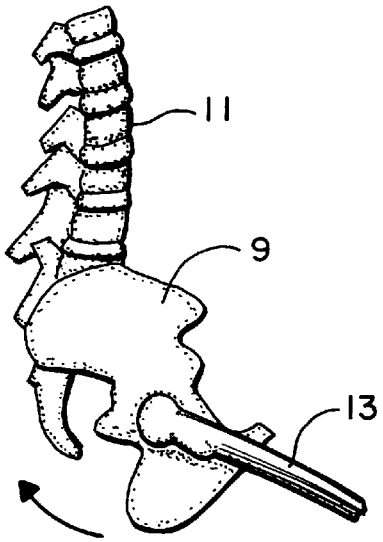
FIG. 1 is a schematic side view of the human lumbar spine and pelvis to illustrate anterior pelvic tilt.

The front portion 25 of the seat 12 is shaped with the cutouts 18 for the thighs which cut outs 18 are separated in the front by a pommel 26. The pommel 26 is elevated slightly to keep the user from sliding forwardly out of the chair. The pommel 26 is also used to keep the user sitting back in the chair so as to push the lumbar spine 11 into the lumbar roll 10 for further lumbar support. The cutouts 18 are shaped to accommodate the user's thighs so that the knee joints are below the hip joints. With the proper cutouts 18, the thighs should be positioned so that there is an angle between the pelvis 9 and the spine 11 of between 100 and 120 degrees as illustrated in FIG. 1. In this position, if standard orthopedic measurement of hip flexion is taken, it would be between 100 and 120 degrees of hip flexion. Conventional chairs keep the hips flexed at 90 degrees or less.

The seat 12 is attached to a base 28 that has a tilting mechanism 30 of any suitable well-known design. The tilting mechanism 30 is constructed to allow the seat 12 to tip backwards and not forwards or from side to side. The tilting mechanism 30 is not shown in detail since such mechanisms are well known to those skilled in the art. The tilting mechanism 30 allows the user of the chair to extend the low back by doing a sitting back bend. A sitting back bend is an exercise where the individual sits in the chair and arches the back against the lumbar roll 10 and further extends the lumbar spine 11. The concavity of the lumbar spine 11 is accentuated by the convexity of the lumbar roll 10 and the action of the user extending the back against the lumbar roll 10. This maneuver is improved by the ability of the user to tilt back in the chair to the extent shown in FIG. 6. The user may work on improving the lumbar lordosis by "pumping" the lumbar disc whenever this sitting back bend is performed. A chair constructed according to the principles of the invention provides for the performance of this exercise.

The base 28 of the chair is preferably a five star base which has five legs 32 that extend outwardly from a vertical adjustable column 32. The base 28 is therefore connected to the seat 12 of the chair by a tilting mechanism and an adjustable column 31. The column 31 may be moved up or down to accommodate the user's height. It is important that height of the seat 12 be sufficient to keep the center of rotation of the hip joint above the center of rotation of the knee joint.

Having thus described the invention in connection with the preferred embodiments thereof, it will be evident to those skilled in the art that various revisions can be made to the preferred embodiments described herein without departing from the spirit and scope of the invention. It is my intention, however, that all such revisions and modifications that are evident to those skilled in the art will be included within the scope of the following claims.

What is claimed is as follows:

1. An orthopedic chair for maintaining a user seated on the chair with the user's lumbar spine in a condition of lordosis and thereby assisting the user to sit with the back more erect by taking the stress off the user's cervical spine as well as the lumbar spine, said chair comprising: a generally upwardly extending chair back having a lumbar roll positioned to engage the user's back along the lumbar spine and place the lumbar spine in a position of lordosis, a seat combined with the chair back and having a front portion and a rear portion with the rear portion positioned below the lumbar roll, said seat having an upper surface engageable with the user's thighs when the user is seated on the chair, the upper surface of the seat being contoured to form thigh supports that at the rear portion of the seat are at a level above the thigh supports at the front portion of the seat to support the user's thighs so that the user's knee joints are positioned below the user's hip joints, the upper surface of the seat also having a pommel located between the thigh supports along th front portion of the seat to keep the user from sliding forwardly and thereby maintain engagement of the lumbar spine with the lumbar roll, and a support base combined with the seat and chair back to support the seat at a selected level.

2. The orthopedic chair of claim 1 in which the support includes means to adjust the height of the seat to raise and lower the height of the seat to a selected level.

3. The orthopedic chair of claim 1 in which the pommel extends outwardly from the front portion of the seat beyond the thigh supports.

4. The orthopedic chair of claim 3 in which the support base includes means to adjust the height of the seat to raise and lower the height of the seat to a selected level.

* * * * *